US007000808B2

(12) United States Patent
Schuessler

(10) Patent No.: US 7,000,808 B2
(45) Date of Patent: Feb. 21, 2006

(54) SPOUT DESIGN

(75) Inventor: Michael H. Schuessler, York, PA (US)

(73) Assignee: The Dial Corporation, Scottsdale, AZ (US)

( * ) Notice: Subject to any disclaimer, the term of this patent is extended or adjusted under 35 U.S.C. 154(b) by 115 days.

(21) Appl. No.: 10/364,615

(22) Filed: Feb. 11, 2003

(65) Prior Publication Data

US 2003/0178450 A1 Sep. 25, 2003

Related U.S. Application Data

(60) Provisional application No. 60/360,331, filed on Feb. 28, 2002.

(51) Int. Cl.
*B67D 25/40* (2006.01)

(52) U.S. Cl. ..... 222/570; 222/569; 220/784

(58) Field of Classification Search ..... 222/108, 222/109, 111, 420, 567, 569, 570, 571; 220/784
See application file for complete search history.

(56) References Cited

U.S. PATENT DOCUMENTS 1,941,050 A * 12/1933 Punte ..... 220/784
4,346,815 A * 8/1982 Raymor et al. ..... 220/784
4,702,389 A * 10/1987 Bozinovich et al. ..... 220/784
4,830,234 A * 5/1989 Odet ..... 222/109
4,852,770 A * 8/1989 Sledge et al. ..... 222/153.14
4,974,749 A * 12/1990 Mon ..... 222/109
4,984,714 A * 1/1991 Sledge ..... 222/109
4,993,605 A * 2/1991 Del'Re ..... 222/109
5,108,009 A 4/1992 Davidson et al.
5,221,027 A * 6/1993 Gibilsco ..... 222/420
5,234,130 A * 8/1993 Benioff et al. ..... 222/111
5,435,467 A * 7/1995 Ekkert et al. ..... 222/109
5,649,650 A * 7/1997 Klauke ..... 222/570
5,855,299 A * 1/1999 Arnold et al. ..... 222/109

FOREIGN PATENT DOCUMENTS

EP 369559 A1 * 5/1990

* cited by examiner

*Primary Examiner*—Michael Mar

*Assistant Examiner*—Melvin A. Cartagena

(74) *Attorney, Agent, or Firm*—Snell & Wilmer LLP

(57) ABSTRACT

A spout for containers with pourable contents configured to be securely retained to the container. The spout remains secure by the shape and/or design of the spout, most notably the interaction of circumferential beads on the outer wall of the spout with an inwardly extended bead on the neck of the container.

9 Claims, 2 Drawing Sheets

SPOUT DESIGN

CROSS-REFERENCE TO RELATED APPLICATIONS

This application claims priority to U.S. Provisional Patent Application No. 60/360,331, filed Feb. 28, 2002.

FIELD OF INVENTION

The present invention relates generally to spouts for liquid containers and more particularly to spouts that are configured to improve spout retention within the container.

BACKGROUND OF THE INVENTION

Designs for containers used for storing, dispensing, and measuring pourable contents such as liquids, powders, and other pourable substances typically include a container for holding the pourable substance, a cap that attaches to the container and a spout attached to the container for facilitation of pouring of the contents. Various spout configurations are known, and have various other properties (e.g., drip free, etc.) However, while these designs have proven generally successful with consumers, the spout may become detached from the container. For example, during the filling operation, if the spout is not securely affixed to the container, the spout may either fall into or otherwise be removed from the container. In such a case, leakage of the contents of the container may occur.

Particularly problematic is the case where the spout is caused to fall into the container. When the spout falls into the container it is difficult to remove given the typically narrow nature of the orifice into which the spout is placed.

Prior attempts to develop a spout that addresses some of the above disadvantages have been met with varied success. For example, U.S. Pat. No. 5,108,009 entitled "Leak and Drip Resistant Storage Dispensing and Measuring Package" and issued to Davidson et al., generally discloses an outwardly extending collar located at the very upper edge of a spout, which rests or engages a top edge of the neck of a container and is intended to keep the spout from falling into the container.

There are various benefits, however, to a spout that does not have such an outer collar and accordingly, there remains a need for spouts thus configured.

SUMMARY OF THE INVENTION

The present invention provides a spout that is configured to be securely retained to a container for pourable contents that addresses many of the shortcomings of the prior art. For example, in accordance with various aspects of the present invention, a spout is configured to engage a neck of a container such that the spout is maintained in the neck without falling into the container and/or such that the spout is not readily removable from the neck.

In accordance with an exemplary embodiment of the present invention, the spout accomplishes this by its shape and configuration. In one exemplary embodiment, intermittent circumferential beads are provided on the outer wall between the top and the bottom of the spout. The circumferential beads are configured to engage with generally corresponding inwardly extending beads found on the inner surface of the neck of the container. In accordance with various aspects of the present invention, engagement of the circumferential beads with the neck beads thus provides a seal between the spout and container and/or tends to prevent the spout from either falling into or otherwise being easily removed from the container. Additionally or alternatively, the spout may be configured with a frustoconical shape or otherwise taper from a larger upper edge to a smaller lower edge, further aiding in preventing the spout from falling into the container.

BRIEF DESCRIPTION OF THE DRAWINGS

Additional aspects of the present invention will become evident upon reviewing the non limiting embodiments described in the following specification and claims taken in conjunction with the accompanying drawing FIG. 1 illustrating a side view of an exemplary spout in accordance with the present invention.

DETAILED DESCRIPTION

The following description of the present invention is of exemplary, non-limiting embodiments only and is not intended to limit the scope, applicability, or configuration of the invention in any way. Rather, the following description merely provides convenient illustrations for implementing illustrative embodiments of the invention. For example, various changes may be made in the design and arrangement of the elements (e.g., the material and shape of the spout) described in these embodiments without departing from the scope of the invention as set forth in the appended claims.

That being said, generally, in accordance with the present invention, a spout 18 is provided that is configured to be securely retained in a container 12 for pourable contents. For example, in accordance with various aspects of the present invention, spout 18 is configured to engage a neck 14 of container 12 such that spout 18 is suitably maintained in the container during preparation (e.g., filling of container 12) and use thereof, for example, in connection with the dispensing of cleaning materials (e.g., detergents) delivered through use of container 12.

Figure 1:
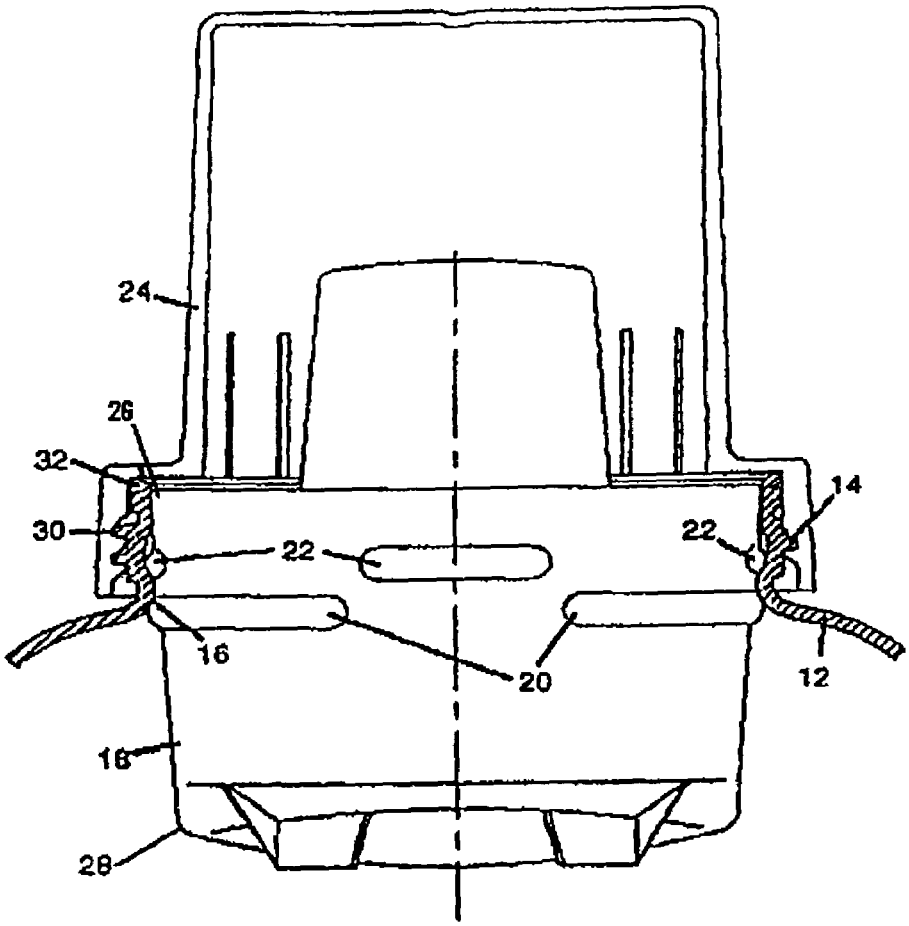
Figure 2:
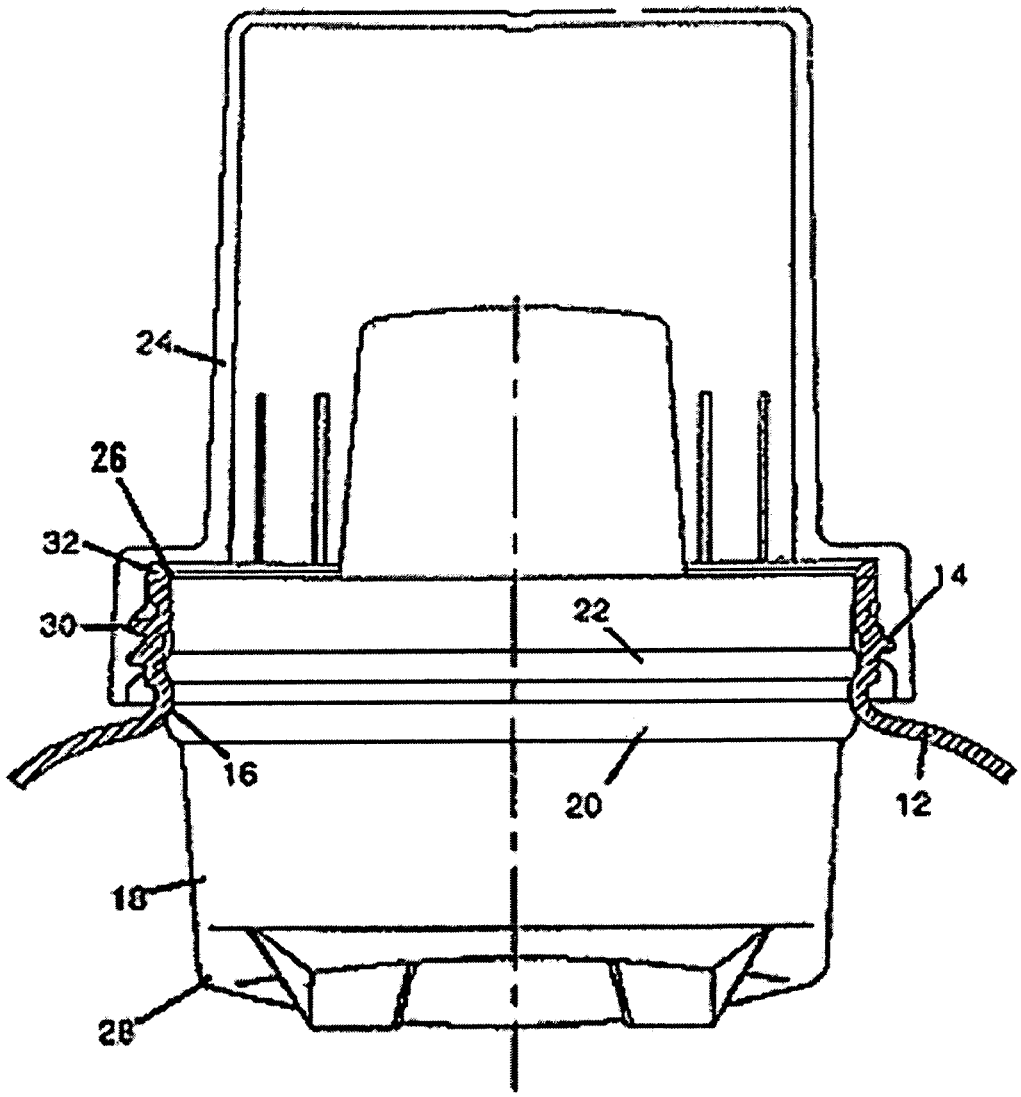

In accordance with an exemplary embodiment of the present invention, and with reference to FIG. 1, spout 18 preferably includes a locking mechanism comprising varying shapes and configurations. As will be explained in greater detail herein below, in accordance with this exemplary embodiment, the locking mechanism comprises a raised bead formed in the spout which preferably cooperates with a portion of neck 14 of container 12. Additionally, in certain embodiments, such as is shown in the illustrated embodiment, the overall shape of spout 18 aids in suitably securing spout 18 to container 12.

Briefly, in the illustrated embodiment, spout 18 is configured for use with a liquid container 12 and a cap 24. These components are typically molded from plastic materials. In the illustrated embodiment, container 12 preferably includes a threaded neck 14 so that cap 24 can be attached to neck 14.

In various embodiments of the present invention, locking mechanism comprises a locking device formed on spout 18 which cooperates with a portion of neck 14 of container 12. For example, with continued reference to FIG. 1, locking mechanism of spout 18 comprises intermittent circumferential beads 20, 22 on an outer wall of spout 18 between an upper edge 26 and a lower edge 28 of spout 18. In the presently described embodiment, multiple beads, namely beads 20, 22, which are offset along the axis of spout 18, are utilized. However, any number of beads and/or bead configurations may likewise be substituted, including the use of only one bead, and likewise may be configured in any number of position besides being offset. Additionally, beads 20, 22 need not be intermittent, but rather may comprise continuous, concentric rings. Accordingly, it will be appreciated that any number of configurations for locking mechanism may fall within the scope of the present invention to the extent that the locking mechanism aids in securely retaining spout 18 in neck 14 of container 12.

In the presently described embodiment and with continued reference to FIG. 1, beads 20, 22 preferably are suitably configured and positioned on/in wall of spout 18 between upper edge 26 and lower edge 28 to engage retaining devices found on container 12. For example, in the presently described embodiment, retaining devices comprise an inwardly extending bead 16 formed on an inner surface of neck 14 of container 12, which engages beads 20, 22. The engagement of beads 20, 22 with neck bead 16 may be accomplished in any manner (such as by "snap" or "press" fit), and on a particularly preferred aspect of this embodiment of the present invention, the engagement of beads 20, 22 with neck bead 16 suitably provides a seal between spout 18 and container 12 such that the contents of container 12 will not pass between spout 18 and neck 14. In any event, in accordance with various aspects of the present invention, spout 18 is suitably secured to neck 14 such that spout 18 is adequately prevented from either falling into container 12 or being removed from container 12 during such operations as filling of container 12, use of container 12 and the like. Accordingly, it will be appreciated that retaining devices may include any number of configurations to the extent that retaining devices engage with beads 20, 22.

Additionally, in its various embodiments, spout 18 may be configured with an overall shape that prevents spout 18 from falling into container 12. For example, spout 18 may have a substantially frustoconical shape or otherwise taper from larger upper edge 26 to smaller lower edge 28, further aiding in preventing the spout from falling into the container.

Lastly, it should be appreciated that the present invention has been described above with reference to various exemplary embodiments. Those skilled in the art will recognize that changes and modifications may be made to these embodiments without departing from the scope of the present invention. For example, it should be appreciated that spout 18 may be suitably configured to include various other features, including, without limitation, drip-free characteristics and the like. Various other changes to the circumferential beads and overall shape of the spout may also be made. These and other changes or modifications are intended to be included within the scope of the present invention as set forth herein.

What is claimed is:

1. A spout for integration with a container, the spout having an upper edge and a lower edge and an outer surface extending therebetween, comprising:

first and second sets of intermittent circumferential beads located on the outer surface of the spout, each having at least two segments;

said first and second sets of intermittent circumferential beads being offset along an axis of the spout;

one of said at least two segments of said first set of intermittent circumferential beads substantially corresponding to a space between said at least two segments of said second set of intermittent circumferential beads; and said intermittent circumferential beads configured to engage a retaining device on an inner surface of the container.

2. The spout of claim 1, wherein the spout has a frustoconical shape.

3. The spout of claim 1, wherein the upper edge has an upper perimeter and the lower edge has a lower perimeter and said upper perimeter is greater than said lower perimeter.

4. The spout of claim 1, wherein said retaining device comprises an inwardly extending bead.

5. A liquid dispensing bottle comprising:

a neck;

a frustoconically shaped spout having an upper edge and a lower edge and a surface extending therebetween;

first and second sets of intermittent circumferential beads located on said surface, each having at least two segment;

said first and second sets of intermittent circumferential beads offset along an axis of said spout;

one of said at least two segments of said first set of intermittent circumferential beads substantially corresponding to a space between said at least two segments of said second set of intermittent circumferential beads; and said intermittent circumferential beads configured to engage an inwardly extending bead on an inner surface of said neck.

6. A spout for integration with a container, the spout having an upper edge and a lower edge and an outer surface extending therebetween, comprising:

first and second sets of intermittent circumferential beads located on the outer surface of the spout, each having at least two segments;

said first and second sets of intermittent circumferential beads being offset along an axis of the spout; and one of said at least two segments of said first set of intermittent circumferential beads substantially corresponding to a space between said at least two segments of said second set of intermittent circumferential beads.

7. The spout of claim 6, wherein the spout has a frustoconical shape.

8. The spout of claim 6, wherein the upper edge has an upper perimeter and the lower edge has a lower perimeter and said upper perimeter is greater than said lower perimeter.

9. The spout of claim 6, wherein said retaining device comprises an inwardly extending bead.

* * * * *